US011780659B2

(12) United States Patent
Gauxachs et al.

(10) Patent No.: US 11,780,659 B2
(45) Date of Patent: Oct. 10, 2023

(54) TETHERED CLOSURE DEVICE

(71) Applicant: Nypro Inc., Clinton, MA (US)

(72) Inventors: Nuria Gauxachs, Tortosa (ES); Ismael Castellvi, Tortosa (ES); Pau Mauri, Tortosa (ES); Emilio Castella, Tortosa (ES); Jeffrey C. Minnette, St. Petersburg, FL (US); Ryan P. Davidson, St. Petersburg, FL (US)

(73) Assignee: Nypro Inc., Clinton, MA (US)

( * ) Notice: Subject to any disclaimer, the term of this patent is extended or adjusted under 35 U.S.C. 154(b) by 107 days.

(21) Appl. No.: 17/428,450

(22) PCT Filed: Feb. 10, 2020

(86) PCT No.: PCT/US2020/017458
§ 371 (c)(1),
(2) Date: Aug. 4, 2021

(87) PCT Pub. No.: WO2020/163855
PCT Pub. Date: Aug. 13, 2020

(65) Prior Publication Data

US 2022/0106092 A1 Apr. 7, 2022

(30) Foreign Application Priority Data

Feb. 8, 2019 (ES) ..... ES201930105

(51) Int. Cl.
*B65D 55/02* (2006.01)
*B65D 5/74* (2006.01)
(Continued)

(52) U.S. Cl.
CPC ..... *B65D 55/024* (2013.01); *B65D 5/748* (2013.01); *B65D 47/0857* (2013.01);
(Continued)

(58) Field of Classification Search
CPC ..... B65D 51/1688; B65D 51/1666; B65D 51/1627; B65D 1/22; B65D 5/00;
(Continued)

(56) References Cited

U.S. PATENT DOCUMENTS 5,482,176 A * 1/1996 Maietta ..... B65D 5/748 215/220
6,041,968 A * 3/2000 Weiteder ..... B65D 5/748 222/545
(Continued)

FOREIGN PATENT DOCUMENTS

CN 1662422 A 8/2005
CN 101056799 A 10/2007
(Continued)

OTHER PUBLICATIONS

Office Action issued in corresponding Chinese application No. 202080013347.3 dated Jul. 25, 2023.

*Primary Examiner* — Kareen K Thomas
(74) *Attorney, Agent, or Firm* — Young Basile Hanlon & MacFarlane, P.C.

(57) ABSTRACT

A tethered closure device for a beverage container, a cap element and a beverage container. It is provided that a tethered closure device for a beverage container comprises the following components: A frame device and a cap element with an at least partially connected recloseable lid element, wherein the cap element is rotatable disposed to the frame device. The tethered closure device further comprises at least two temper evident elements, wherein the first temper evident element is disposed between the cap element and the frame device and the second temper evident element is disposed between the cap element and the lid element. Furthermore, a cap element and a beverage container is provided.

10 Claims, 6 Drawing Sheets

(51) Int. Cl.
*B65D 47/08* (2006.01)
*B65D 55/16* (2006.01)

(52) U.S. Cl.
CPC ..... *B65D 55/16* (2013.01); *B65D 2251/1025* (2013.01); *B65D 2401/15* (2020.05)

(58) Field of Classification Search
CPC ..... B65D 41/3409; B65D 41/3428; B65D 55/024; B65D 5/748; B65D 47/0857; B65D 55/16; B65D 2251/1025; B65D 2401/15; B65D 5/746; B65D 50/00; B65D 51/22
See application file for complete search history.

(56) References Cited

U.S. PATENT DOCUMENTS

| | | | | |
|---|---|---|---|---|
| 6,116,441 | A | 9/2000 | Decelles et al. | |
| 6,769,539 | B2 * | 8/2004 | Stern | B65D 47/38 206/219 |
| 6,820,764 | B2 * | 11/2004 | Miani | B65D 5/748 222/91 |
| 7,036,683 | B2 * | 5/2006 | Dubach | B65D 5/748 222/83 |
| 7,484,641 | B2 * | 2/2009 | Casale | B65D 5/748 222/83.5 |
| 7,997,436 | B2 * | 8/2011 | Bolli | B65D 5/748 215/297 |
| 8,672,167 | B2 * | 3/2014 | Leuenberger | B65D 5/748 220/267 |
| 9,145,239 | B2 * | 9/2015 | Wohlgenannt | B65D 47/122 |
| 9,738,427 | B2 * | 8/2017 | Backes | B65D 51/222 |
| 2006/0071000 | A1 | 4/2006 | Weist et al. | |
| 2006/0249474 | A1 | 11/2006 | Sawyer et al. | |
| 2007/0039915 | A1 | 2/2007 | Jackel | |
| 2008/0169261 | A1 | 7/2008 | Druitt et al. | |
| 2008/0210745 | A1 | 9/2008 | Rigling | |
| 2010/0018992 | A1 * | 1/2010 | Dill | B65D 5/747 222/83 |
| 2010/0308006 | A1 * | 12/2010 | Walker-Smith | B65D 55/16 215/305 |
| 2010/0320209 | A1 | 12/2010 | Leuenberger et al. | |
| 2011/0095059 | A1 * | 4/2011 | Giraud | B65D 5/746 222/541.9 |
| 2012/0181281 | A1 | 7/2012 | Ott | |
| 2013/0043260 | A1 | 2/2013 | Barron | |
| 2014/0230379 | A1 | 8/2014 | Casale et al. | |
| 2016/0016703 | A1 | 1/2016 | Muhlemann | |
| 2021/0206550 | A1 * | 7/2021 | Edwards | B65D 51/243 |

FOREIGN PATENT DOCUMENTS

| | | | |
|---|---|---|---|
| CN | 107672928 | A | 2/2018 |
| EP | 1319605 | A1 | 6/2003 |
| EP | 1364886 | A1 | 11/2003 |
| EP | 3689771 | A1 | 8/2020 |
| JP | 2001171716 | A | 6/2001 |
| JP | 2015034011 | A | 2/2015 |
| WO | 9700817 | A1 | 1/1997 |
| WO | 9951502 | A1 | 10/1999 |
| WO | 0105675 | A1 | 1/2001 |
| WO | 2011046523 | A1 | 4/2011 |

* cited by examiner

TETHERED CLOSURE DEVICE

CROSS REFERENCE TO RELATED APPLICATION

The present application claims priority to Spanish Patent Application No. P201930105, filed Feb. 8, 2019, incorporated herein in its entirety.

TECHNICAL FIELD

The invention relates to a tethered closure device for a beverage container, a cap element and a beverage container.

BACKGROUND

Beverage containers in form of bottles or drinking packages are very often not only used at home but are as well consumed on the go. In this context beverage containers are known who comprise a closeable cap. In this context, screw-on lids are very common, which close the beverage container. The known lids are often a separate part of a closing mechanism for the beverage container, which could be lost during the usage phase. Increasingly, both consumers and policy makers are calling for more sensitive approaches to future product designs for the associated environmental impact. In terms of beverage containers, this not only affects their recyclability, but also in advance both the circumstances in which they are produced and the extent to which an environmentally use during the usage phase is guaranteed or at least made easier for the consumer. It is increasingly becoming the focus of attention that the beverage containers to be used do not release more objects beyond the container into the environment during the use phase, be it consciously or partially provided by the consumers. To counteract this disadvantage, tethered closures are provided which are connected to the bottle.

Tethered closures make it possible to provide an environmentally friendly device since no parts can be lost and, for example, disposed of improperly.

Tethered closures usually comprise a connection part, which connects the lid itself with one part of the beverage container. For example, a typical type of this connection may be a kind of chain or the like.

A disadvantage of these tethered closures used so far can be seen in the fact that a user does not know reliably whether the drink has been previously opened and therefore is still unused and fresh.

SUMMARY

It is therefore one object of the presented invention to provide an environmentally friendly tethered closure device, which allows a user to recognize whether the beverage container is still unused and which allows a comfortable and easy handling of it.

In a preferred embodiment of the invention it is provided that a tethered closure device for a beverage container comprises the following components: A frame device and a cap element with an at least partially connected recloseable lid element, wherein the cap element is rotatable disposed to the frame device. The tethered closure device further comprises at least two temper evident elements, wherein the first temper evident element is disposed between the cap element and the frame device and the second temper evident element is disposed between the cap element and the lid element. In this way it is possible for a user to quickly and easily recognize whether the drink has already been opened or is still fresh and unused. In this case, a user can not only recognize whether the drink is generally already open, but in addition, the user can see to what extent the lid and thus a potential contact point for drinking is even unused. In this context, temper evident elements are to be understood as any mechanisms, which make it possible to detect a visual or haptic proof of first-time use. In this case, the form or shape of such temper evident elements could be varied as long as the functionality is guaranteed. For example the presented device could be used for a beverage container in the form of a bottle or a drinking package or the like. In addition, this concept provides an environmentally friendly solution, as the parts are because the components are arranged so as to avoid accidental loss or unconscious falling off. In other words, the proposed solution offers a customer-friendly and environmentally friendly functionality of the device, while avoiding that individual parts can be lost during the use phase, so that improper disposal of individual parts is prevented.

Furthermore, in a preferred embodiment of the invention it is provided that a cap element for use in a tethered closure device according to claims 1 to 9 comprises the following components: An at least partially connected recloseable lid element and at least two temper evident elements, wherein the first temper evident element is designed to be connected to a counter part or an opening mechanism of a beverage container and the second temper evident element is disposed between the cap element and the lid element, wherein the second temper evident element comprises a closing mechanism, so that the lid element can be closed recloseable to the cap element after a first usage of the second temper evident element. The advantages mentioned above apply insofar as transferable also for the presented cap element. In addition, users can benefit from the fact that the second temper evident element can also be used as a resealable closure, so that a very comfortable and easy handling of it is guaranteed.

Furthermore, in a preferred embodiment of the invention it is provided that a beverage container comprises at least one opening sealed with a seal element, wherein a tethered closure device according to claims 1 to 9 is disposed on the sealed opening. The advantages mentioned above apply insofar as transferable also for the presented beverage container.

Further preferred embodiments of the invention will become apparent from the remaining features mentioned in the subclaims.

In a further preferred embodiment of the invention, it is provided that the cap element comprises a seal opening device comprising at least one tooth element designed to at least partially open a seal element during a rotation movement of the cap element with regard to the frame device, wherein the seal element is disposed between the beverage container and the frame device, so that liquid can flow out of the package through the opened seal element and through the closure device to the outside. In this way, the presented device can be used even if an additional seal element is present. A user can easily recognize from the first temper evident element and its state whether the seal element has been torn open and thus the beverage is already in an open state. In this context, an at least partial opening means that a minimum opening of the seal element is achieved, so that the contents, for example any liquid present in the container, can be served conveniently and in a customer-friendly manner. In extreme cases, for example, the seal element could be almost completely broken.

In a further preferred embodiment of the invention, it is provided that the second temper evident element comprises a closing mechanism, so that the lid element can be closed recloseable to the cap element after a first usage of the second temper evident element. In addition to the aforementioned advantages, users can benefit from the fact that the second temper evident element can also be used as a resealable closure, so that a very comfortable and easy handling of it is guaranteed.

In a further preferred embodiment of the invention, it is provided that the frame device comprises a base element and a collar element, which is disposed at the base element, wherein the collar element is adapted to receive the cap element. In this way, a reliable connection between the cap element and the frame device can be realized, so that the cap element cannot get lost during the usage phase. In addition, the base element can provide a reliable connection of the device itself to the beverage container, so that all parts can be directly or indirectly connected to the beverage container. This concept thus makes it possible to provide an environmentally friendly device since no parts can be lost and, for example, disposed of improperly.

In a further preferred embodiment of the invention, it is provided that the seal opening device has a cylindrical shape and the at least one tooth element is positioned on an outer edge of the cylindrical shape on an opposite side with regard to a closing position of the lid element on the cap element. A cylindrical shape, which in other words can be made substantially circular, is particularly suitable for a rotating motion functionality, since a uniform and easy-to-handle motion sequence is thus supported. Since the element is positioned on the outer edge, it is moved on a defined path during a movement sequence, so that a reliable opening mechanism of the sealing element is ensured. A comfortable and easy handling of the device is thus possible.

In a further preferred embodiment of the invention, it is provided that the seal opening device has a cylindrical shape and an outer diameter of the seal opening device fits into an inner diameter of the collar element, so that the cap element is rotatable disposed to the frame device and the at least one tooth element is in contact with the seal element. This embodiment thus supports a reliable connection or arrangement of the cap element on the frame device, so that a cohesion of the individual components is made possible to provide an environmentally friendly solution as mentioned above.

In a further preferred embodiment of the invention, it is provided that the first temper evident element is disposed between the cap element and the base element. This embodiment also makes it easier for a user to assess the respective state of the device faster and more directly and above all logically.

In a further preferred embodiment of the invention, it is provided that the first temper evident element comprises at least one bridge element, which forms a breakable connection between the cap element and the base element, so that after a first rotation movement of the cap element with regard to the frame device the broken connection demonstrates an opening condition of the beverage container. As soon as a first opening operation takes place, this bridge element breaks or tears apart. Based on this state of this bridge element, a user is able to recognize immediately (visually or haptically) if the drink is still in an unopened and fresh state or not.

In a further preferred embodiment of the invention, it is provided that the collar element comprises a guiding device with at least one guiding element and the cap element comprises an outer wall element, wherein the collar element is disposed between the outer wall and the seal opening device, wherein the guiding device is designed to lead the seal opening device in a defined manner from a first position to a second position, so that the seal opening device opens at least partially the seal element during a rotation movement of the cap element with regard to the frame device. First, due to the resulting mechanism of outer wall and seal opening device, an even better connection between the cap element and the frame device is possible, so that the cap element cannot get lost during the usage phase. In addition, the guiding element provides a defined opening routine in a use case, resulting in a reliable and easy-to-use device. Thus, after an application, the user can safely assume that the fresh seal element has been broken and the drink is ready for consumption. Furthermore, also the guiding element and its resulting interaction between this and the cap element support an even better connection between the cap element and the frame device.

The presented device could be used for a beverage container in the form of a bottle or a drinking package or the like. The shapes and dimensions of the device can be adapted to the corresponding application in any form. The device can be constructed of only one material or of different materials.

In various embodiments of the invention mentioned in this application are, unless otherwise stated in the individual case, advantageously combinable with each other.

BRIEF DESCRIPTION OF THE DRAWINGS

The invention will be explained below in embodiments with reference to the accompanying drawings. In these drawings.

DETAILED DESCRIPTION

Figure 1:
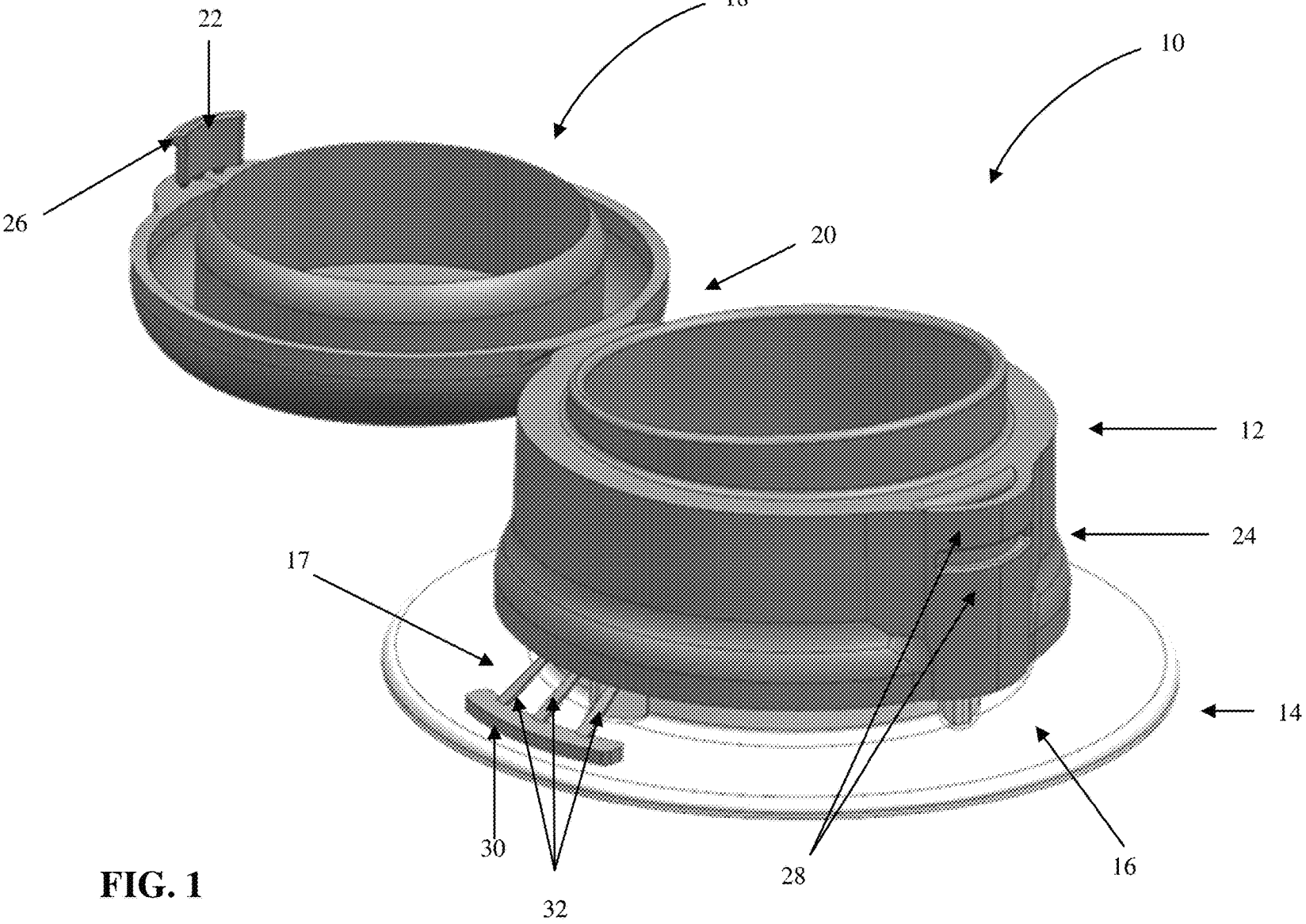
FIG. 1 shows a perspective view of a tethered closure device.

FIG. 1 shows a perspective view of a tethered closure device 10. The tethered closure device 10 is shown with a cap element 12 and a frame device 14 wherein the cap element 12 is disposed on the frame device 14, so that the frame device 14 is only partially visible. More precisely, only a base element 16 of the frame device 14 can be recognized. The base element 16 is shown substantially in a circular disc-shaped form and has a larger diameter than the cap element 12 shown above. Also, the cap element 12 has a substantially round shape, wherein a basic shape of the cap element 12 is substantially cylindrical. Between the cap element 12 and the frame device 14 a first temper evident element 17 is shown. This first temper evident element 17 is in an unused state and will be described further below. The cap element 12 can for example be arranged on the frame device 14, so that it is plugged and thus cannot be removed without a certain effort and yet can be rotated relative to the frame device 14. In particular, therefore, for example, the cap element 12 cannot simply fall off the frame device 14 when the cap element 12 is aligned in the direction of the ground. Furthermore, the cap element 12 is shown with a lid element 18. The lid element 18 is partially connected to the cap element 12. This connection can for example be physically. In other words, the cap element 12 can be made from the same material as the lid element 18 wherein these parts are connected in a physical connection area 20. This connection area 20 can function as a hinge element or the like, so that the lid element 18 can be placed removable on the cap element 18. In FIG. 1 the lid element 18 is in an open position. The lid element 18 is shown with an already used second temper evident element 22. In this embodiment, the second temper evident element 22 is represented as a projecting substantially rectangular body. The second temper evident element 22 can also have any other shape and dimension, as long as its functionality is not restricted. In addition, the second temper evident element 22 in this embodiment comprises a closing mechanism 24 wherein the closing mechanism 24 is at least partially connected to the cap element 12 and an additional part of the closing mechanism 24 in a form of a locking hook element 26 is physically connected to the second temper evident element 22. The part of the closing mechanism 24, which is connected to the cap element 12 is shown in the form of two stacked semi-annular receiving areas 28. The receiving areas 28 are designed to receive and hold the locking hook element 26, so that the lid element 18, when it is in the closed state, cannot be opened without providing a certain amount of force. For example, the second temper evident element 22 can be fixed physically at least partially to the cap element 12 before a user opens the lid element 18 for the first time. During the opening procedure the physical connection breaks, so that an already opened state can be immediately recognized. In contrast to the second temper evident element 22, the first temper evident element 17 is shown in another design. Strictly speaking, the first temper evident element 17 is disposed between the cap element 12 and the base element 16 of the frame device 14. The first temper evident element 17 comprises a connection member 30, which is disposed directly to the base element 16. Starting from the connection member 30, three bridge elements 32 protrude in the direction of the cap element 12, with the three bridge elements 32 thus forming a breakable connection between the cap element 12 and the base element 16 of the frame device 14. The dimension of the three bridge elements 32 is selected such that during a first rotational movement of the cap element 12 relative to the frame device 14 these bridge elements 32 rupture, so that an already opened state can be immediately recognized. Also the first temper evident element 17 can have any other shape and dimension, as long as its functionality is not restricted. Especially the shapes and dimensions of both, the connection member 30 and the bridge elements 32, are shown in an exemplary way. In other not demonstrated embodiments, these shapes and dimensions can be varied as long as its functionality is not restricted.

Figure 2:
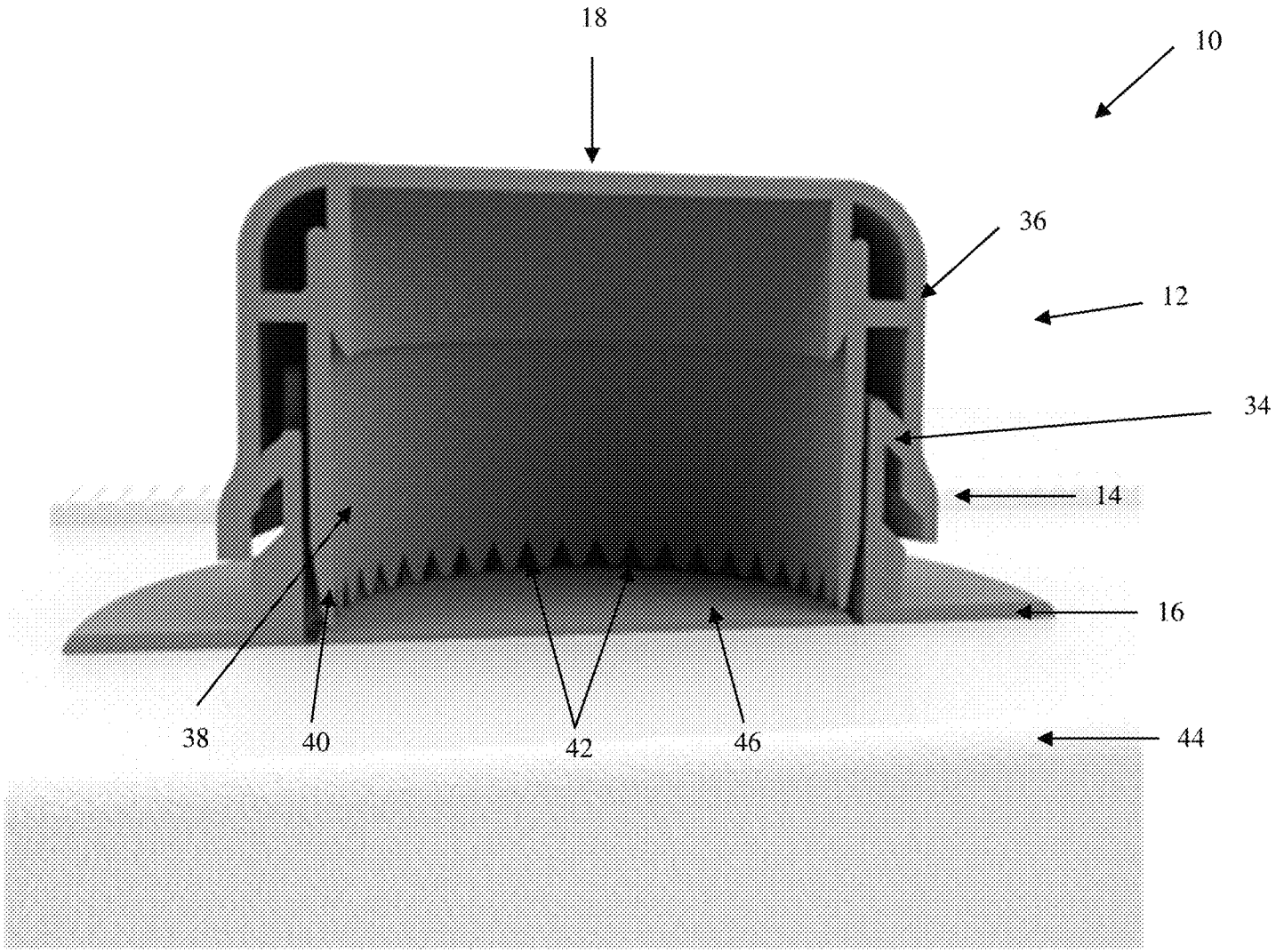
FIG. 2 shows a sectional view of a tethered closure device from FIG. 1.

FIG. 2 shows a sectional view of a tethered closure device 10 from FIG. 1. Both the cap element 12 and the frame device 14 are shown. The cap element 12 is shown with the lid element 18, which is in a closed position. It can be seen that the cap element 12 hat-shaped is placed on the frame device 14. A collar element 34 of the frame device 14, which is disposed on the base element 16 of the frame device 14, is positioned between an outer wall element 36 of the cap element 12 and a seal opening device 38 of the cap element 12. The seal opening device 38 is designed in a substantially cylindrical shape and is shown with an outer diameter 40, which is arranged on the side opposite to the side, which points in a direction, where the lid element 18 is positioned in a closed position of it. Numerous tooth elements 42 are arranged on the outer diameter 40, wherein these tooth elements 42 are shown serially, for example, in series in a row. In FIG. 2 the tethered closure device 10 is placed on a top of a beverage container 44. More precisely, the tethered closure device 10 is placed on a seal element 46 of this beverage container 44, wherein the tooth elements 42 are in contact with this seal element 46. The tooth elements 42 are shown in a substantially triangular shape with the sharp point protruding. Other forms, shapes and dimensions of the tooth elements 42 are conceivable as long as the functionality is guaranteed. For example even only one tooth element 42 could be foreseen, which is in contact with the seal element 46.

Figure 3:
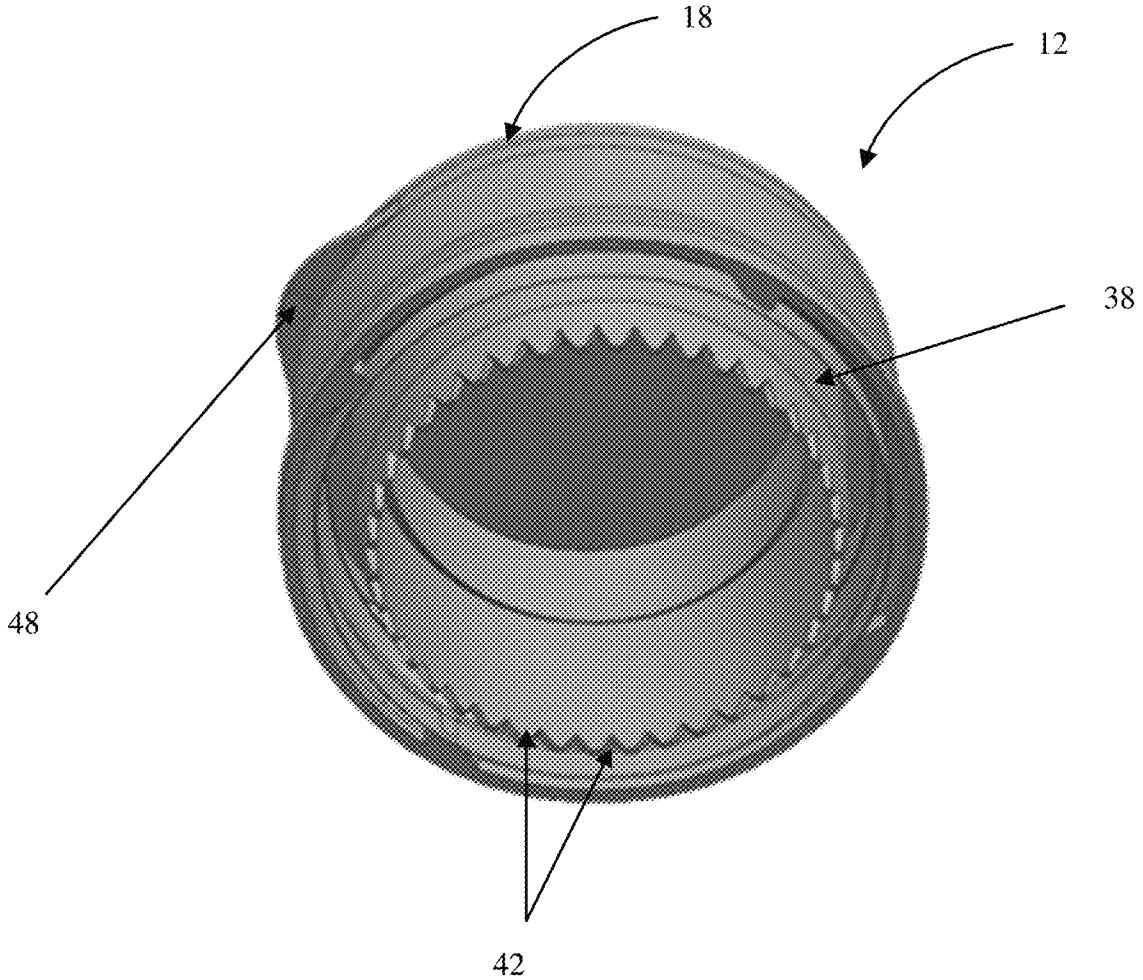
FIG. 3 shows a perspective view of a cap element of a tethered closure device from FIG. 1.

FIG. 3 shows a perspective view of a cap element 12 of a tethered closure device 10 from FIG. 1. The cap element 12 is shown with the lid element 18, which is in a closed position. The lid element 18 comprises an opening aid element 48. This opening aid element 48 is in a form of a protrusion. When a user pushes against this opening aid element 48 with a certain force, the lid element 18 can be lifted from the cap element 12. Furthermore, the seal opening device 38 can be seen in more detail. In particular, it can be seen that the outer diameter 40 is ring-shaped with the various tooth elements 42 in a serial arrangement. In a variant, not shown, only a tooth element 42 could be provided. Also, any shapes and dimensions shown could be varied. The provided examples show only possible variants of the presented device with the associated components.

Figure 4:
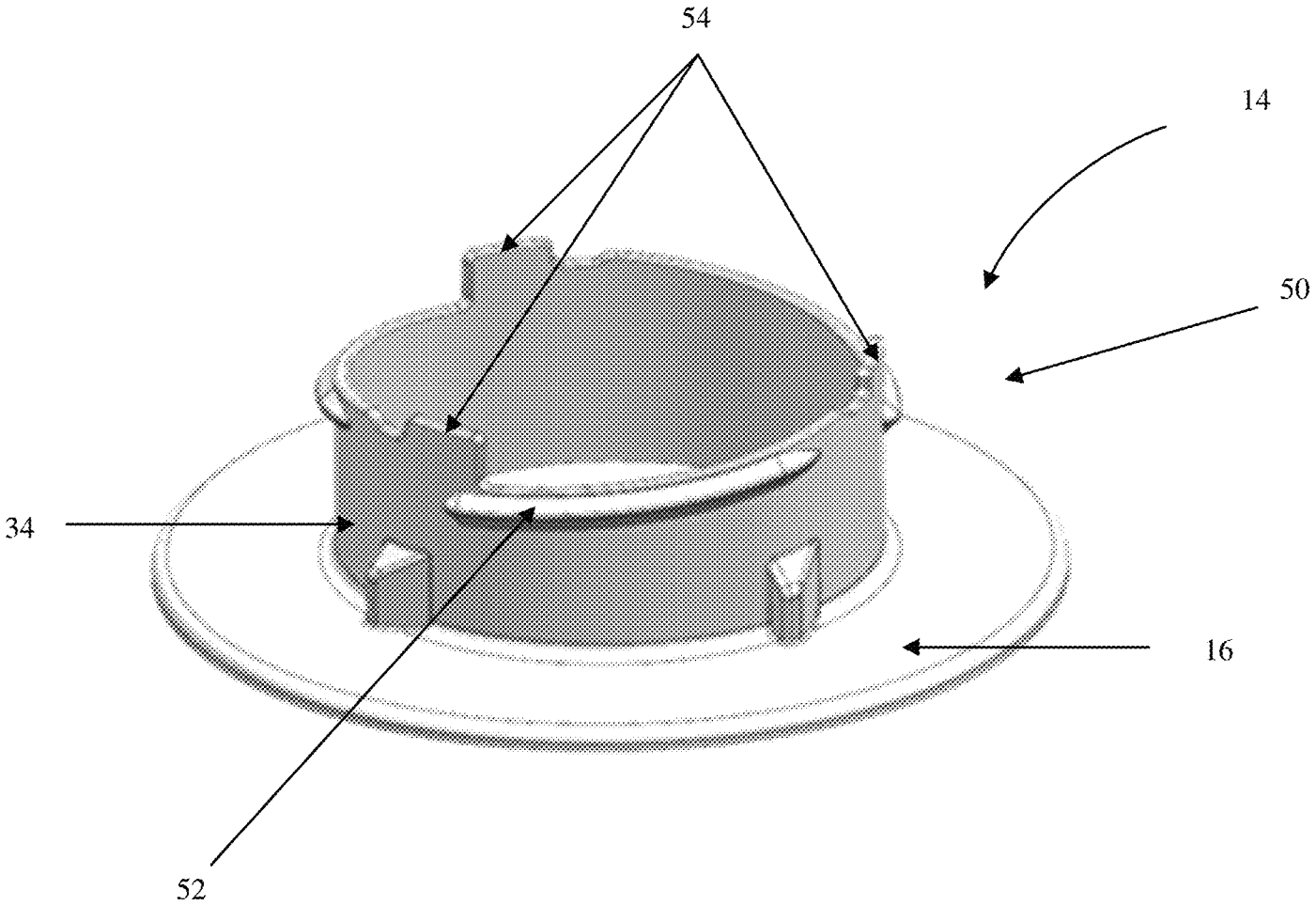
FIG. 4 shows a perspective view of a frame device of a tethered closure device from FIG. 1.

FIG. 4 shows a perspective view of a frame device 14 of a tethered closure device 10 from FIG. 1. The frame device 14 is shown with a collar element 34, which is disposed on a base element 16 of the frame device 14. Furthermore, the frame device 14 is shown with a guiding device 50.

The guiding device 50 comprises various guiding elements 52, 54, 56. In this case, a first guiding element 52 is in the form of an elongated attachment, which is protruding on the collar element 34. A number of second guiding elements 54 are arranged on top of the collar element 34 with respect to the image plane, these second elements 54 being shown in the form of substantially rectangular projections. A number of third guiding elements 56 are arranged with respect to the image plane at the bottom in the transition region between the collar element 34 and the base element 16, these third elements are represented in the form of substantially rectangular projections. The guiding device 50 is designed to lead the seal opening device 38 in a defined manner from a first position to a second position, so that the seal opening device 38 opens at least partially the seal element 46 during a rotation movement of the cap element 12 with regard to the frame device 14. For example, the guiding elements 52, 54, 56 of the guiding device 50 can allow a rotation movement to certain extent, for example a rotation of 60°, 70°, 80°, 90° or 120°. Also, a defined rotation is conceivable up to a stop position in an interval of 40° to 180° or from 60° to 140° or from 90° to 120°.

Figure 5:
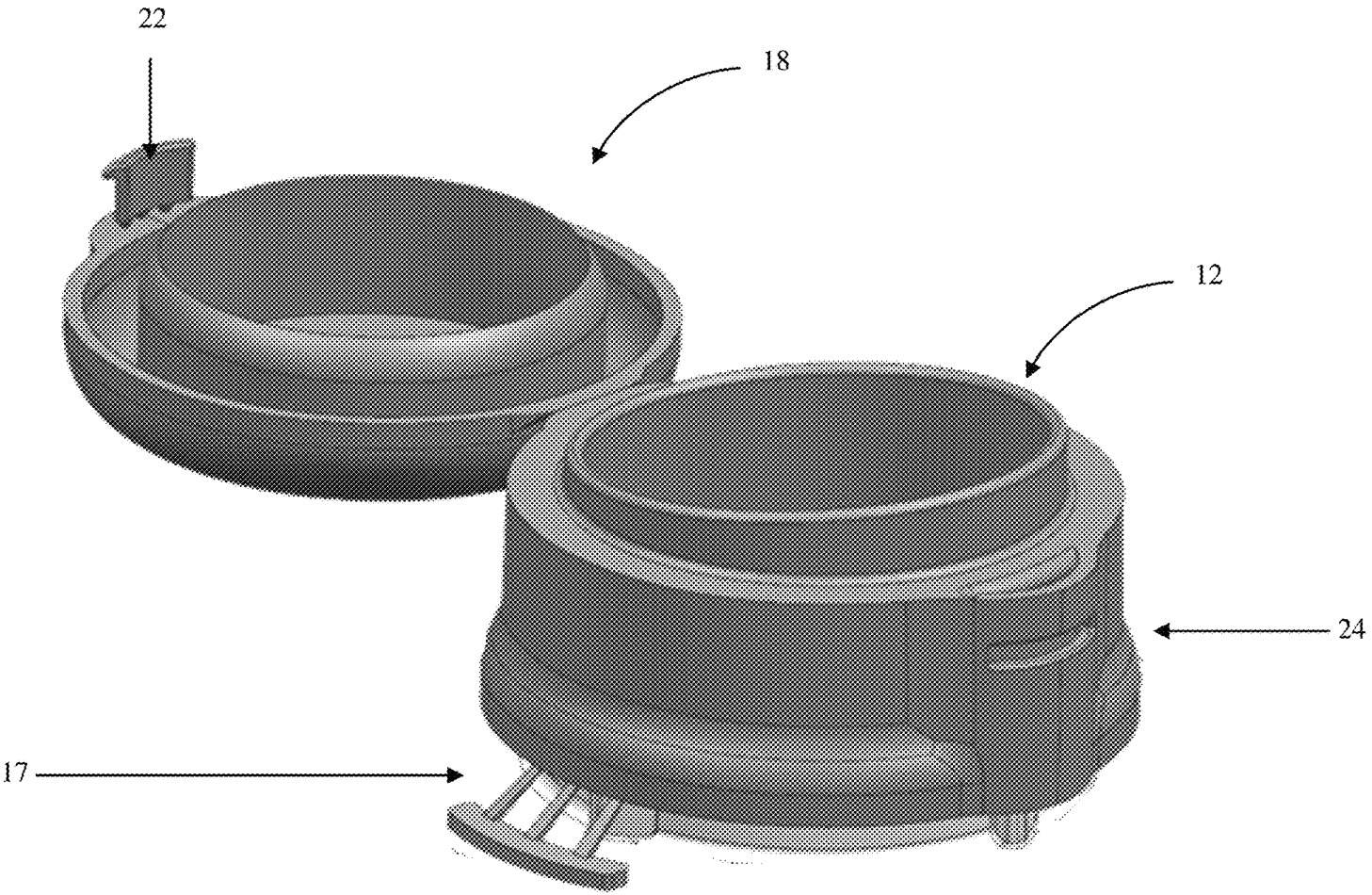
FIG. 5 shows a cap element for use in a tethered closure device.

FIG. 5 shows a cap element 120 for use in a tethered closure device 10. This cap element 120 is substantially similar to the cap element 12 presented above. It also comprises an at least partially connected recloseable lid element 18 and at least two temper evident elements 17, 22, wherein the first temper evident element 17 is designed to be connect to a counter part or an opening mechanism of a beverage container 44 and the second temper evident element 22 is disposed between the cap element 120 and the lid element 18, wherein the second temper evident element 22 comprises a closing mechanism 24, so that the lid element 18 can be closed recloseable to the cap element 120 after a first usage of the second temper evident element 22.

Figure 6:
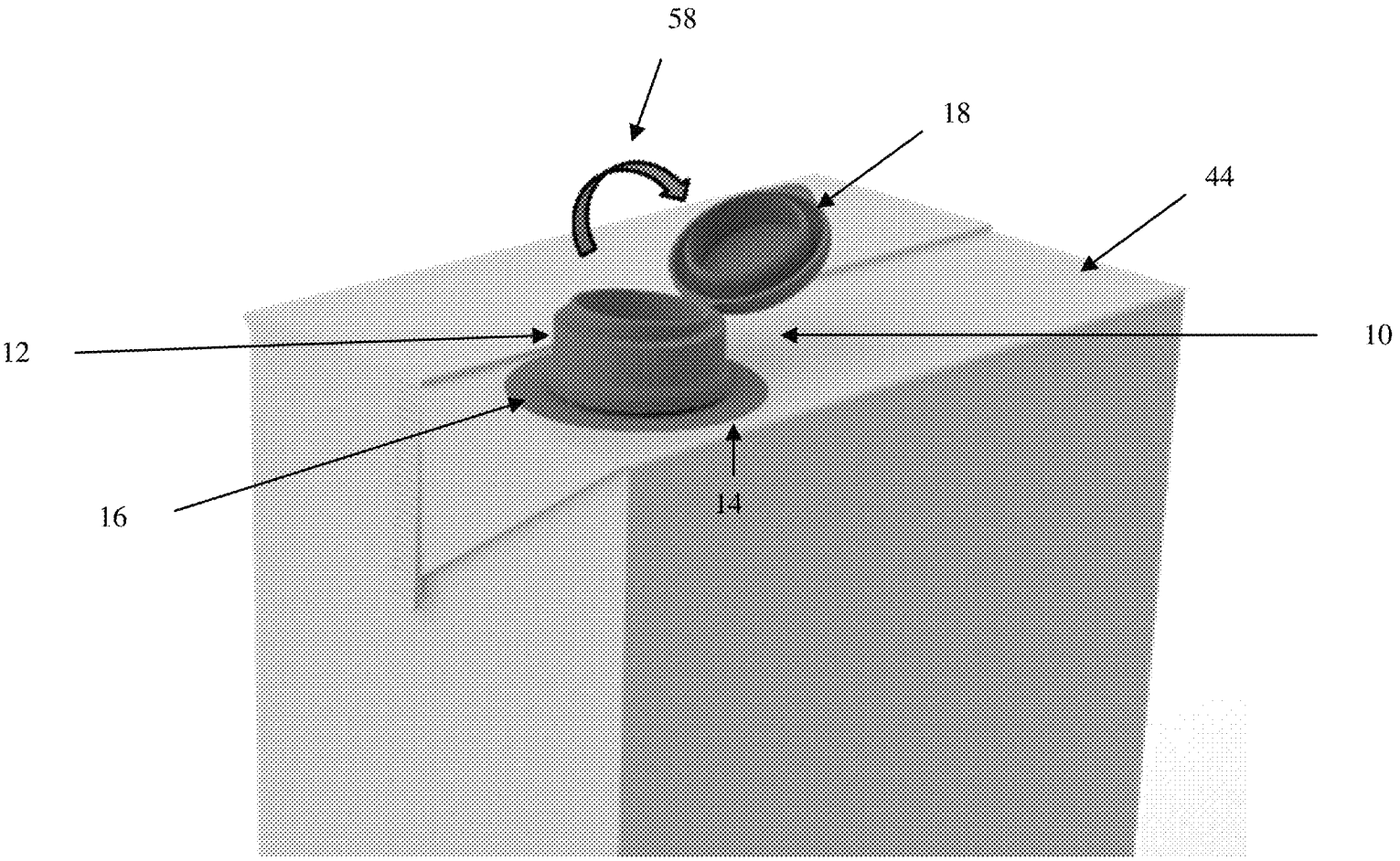
FIG. 6 shows a beverage container with a tethered closure device.

FIG. 6 shows a beverage container 44 with a tethered closure device 10. In this case, the beverage container 44 is a drinking package. The drinking package could be for example substantially built up as a tetra pack. In a variant, not shown, the beverage container 44 could also be a bottle or an object, which is constructed similar to a drinking bottle. The tethered closure device 10 covers an opening of the beverage container 44, so that the opening cannot be seen in this view. Therefore, a seal element 46 covering the opening can also not be seen in this view. The seal element 46 could be for example at least partially made from aluminum or a material composition containing aluminum. The tethered closure device 10 is shown with a cap element 12 and a frame device 14 wherein the cap element 12 is disposed on the frame device 14, so that the frame device 14 is only partially visible. More precisely, only a base element 16 of the frame device 14 can be recognized. The base element 16 is disposed on the beverage container 44. For example it can be glued or fixed in any other way, so that a robust connection between these two parts is provided. The cap element 12 is shown with the connected lid element 18, which is in an open position. An arrow 58 illustrates a direction of movement of the lid element 18.

LIST OF REFERENCE NUMBERS

10 tethered closure device
12 cap element
14 frame device
16 base element
17 first temper evident element
18 lid element
20 connection area
22 second temper evident element
24 closing mechanism
26 locking hook element
28 receiving area
30 connection member
32 bridge element
34 collar element
36 outer wall element
38 seal opening device
40 outer diameter
42 tooth element
44 beverage container
46 seal element
48 opening aid element
50 guiding device
52 first guiding element
54 second guiding element
56 third guiding element
58 arrow
59 recess means
60 recess
62 gap

What is claimed is:

1. A tethered closure device for a beverage container comprising:

a frame device; and a cap element with an at least partially connected recloseable lid element, wherein the cap element is rotatable disposed to the frame device, and wherein the cap element comprises a seal opening device comprising at least one tooth element designed to at least partially open a seal element during a rotation movement of the cap element with regard to the frame device, wherein the seal element is disposed between the beverage container and the frame device so that liquid can flow out of the container through the opened seal element and through the tethered closure device to outside; and at least two tamper evident elements, wherein a first tamper evident element is disposed between the cap element and the frame device and a second tamper evident element is disposed between the cap element and the lid element.

2. The tethered closure device according to claim 1, wherein the second tamper evident element comprises a closing mechanism, so that the lid element can be closed recloseable to the cap element after a first usage of the second tamper evident element.

3. The tethered closure device according to claim 1, wherein the frame device comprises a base element and a collar element, which is disposed at the base element, wherein the collar element is adapted to receive the cap element.

4. The tethered closure device according to claim 1, wherein the seal opening device has a cylindrical shape and the at least one tooth element is positioned on an outer edge of the cylindrical shape on an opposite side with regard to a closing position of the lid element on the cap element.

5. The tethered closure device according to claim 3, wherein the seal opening device has a cylindrical shape and an outer diameter of the seal opening device fits into an inner diameter of the collar element so that the cap element is rotatable disposed to the frame device and the at least one tooth element is in contact with the seal element.

6. The tethered closure device according to claim 3, wherein the first temper evident element is disposed between the cap element and the base element.

7. The tethered closure device according to claim 6, wherein the first tamper evident element comprises at least one bridge element, which forms a breakable connection between the cap element and the base element so that after a first rotation movement of the cap element with regard to the frame device the broken connection demonstrates an opening condition of the beverage container.

8. The tethered closure device according to claim 3, wherein the collar element comprises a guiding device with at least one guiding element and the cap element comprises an outer wall element, wherein the collar element is disposed between the outer wall element and the seal opening device, wherein the guiding device is designed to lead the seal opening device in a defined manner from a first position to a second position so that the seal opening device opens at least partially the seal element during a rotation movement of the cap element with regard to the frame device.

9. A cap for use in a tethered closure device, the cap comprising a cap element, an at least partially connected recloseable lid element and at least two tamper evident elements, wherein a first tamper evident element is configured to be connected to a counter part or an opening mechanism of a beverage container and a second tamper evident element is disposed between the cap element and the lid element, wherein the second temper evident element comprises a closing mechanism so that the lid element can be closed recloseable to the cap element after a first usage of the second tamper evident element, wherein the cap element comprises a seal opening device comprising at least one tooth element designed to at least partially open a seal element during a rotation movement of the cap element, wherein the seal element is disposed with respect to the beverage container so that liquid can flow out through the opened seal element and through the tethered closure device to outside.

10. A beverage container comprising:

at least one opening sealed with a seal element:

a tethered closure device disposed on the sealed opening, wherein the tethered closure device comprises:

a frame device; and a cap element with an at least partially connected recloseable lid element, wherein the cap element is rotatable disposed to the frame device; and at least two tamper evident elements, wherein a first tamper evident element is disposed between the cap element and the frame device and a second tamper evident element is disposed between the cap element and the lid element, wherein the cap element comprises a seal opening device comprising at least one tooth element designed to at least partially open a seal element during a rotation movement of the cap element with regard to the frame device, and wherein the seal element is disposed between the beverage container and the frame device so that liquid can flow out of the container through the opened seal element and through the tethered closure device to outside.

* * * * *